US007758163B2

(12) United States Patent
Petersen et al.

(10) Patent No.: US 7,758,163 B2
(45) Date of Patent: Jul. 20, 2010

(54) BASE AND SUBSTRATE FOR PRINTHEAD ASSEMBLY

(75) Inventors: Daniel W. Petersen, Corvallis, OR (US); John L. Taylor, Corvallis, OR (US); Ashley Childs, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 592 days.

(21) Appl. No.: 11/799,291

(22) Filed: Apr. 30, 2007

(65) Prior Publication Data

US 2008/0266369 A1 Oct. 30, 2008

(51) Int. Cl.
*B41J 2/14* (2006.01)
*B41J 2/16* (2006.01)

(52) U.S. Cl. ..... 347/49; 347/20

(58) Field of Classification Search ..... 347/20, 347/44, 47, 49, 56, 63, 65, 84–87
See application file for complete search history.

(56) References Cited

U.S. PATENT DOCUMENTS

| | | | | |
|---|---|---|---|---|
| 5,818,481 | A | 10/1998 | Hotomi et al. | |
| 5,874,975 | A | 2/1999 | Hotomi et al. | |
| 5,963,234 | A | 10/1999 | Miyazawa et al. | |
| 6,739,519 | B2 | 5/2004 | Stout et al. | |
| 6,749,287 | B2 * | 6/2004 | Osada et al. | 347/86 |
| 2004/0196335 | A1 | 10/2004 | Stout et al. | |
| 2006/0012647 | A1 | 1/2006 | Yamada et al. | |

* cited by examiner

*Primary Examiner*—Juanita D Stephens

(57) ABSTRACT

A printhead assembly includes a base having a pocket formed therein, a substrate having at least one fluid passage formed therethrough received within the pocket of the base, and a printhead die supported by the substrate and communicated with the at least one fluid passage of the substrate.

36 Claims, 4 Drawing Sheets

BASE AND SUBSTRATE FOR PRINTHEAD ASSEMBLY

BACKGROUND

An inkjet printing system may include a printhead, an ink supply which supplies liquid ink to the printhead, and an electronic controller which controls the printhead. The printhead ejects drops of ink through a plurality of nozzles or orifices and toward a print medium, such as a sheet of paper, so as to print onto the print medium. Typically, the orifices are arranged in one or more columns or arrays such that properly sequenced ejection of ink from the orifices causes characters or other images to be printed upon the print medium as the printhead and the print medium are moved relative to each other.

The printhead, often referred to as a printhead die, typically includes one or more ink feed slots which route different colors or types of ink to fluid ejection chambers communicated with the nozzles or orifices of the printhead die. Due to market forces and continuing technological improvements, the length of the printhead die (i.e., print swath) has been increasing while the spacing or width between the ink feed slots (i.e., slot pitch) has been decreasing. This increase in print swath and decrease in slot pitch, although increasing a number of nozzles or resolution of the printhead die, may also increase the potential fragility of the printhead die.

For these and other reasons, there is a need for the present invention.

SUMMARY

One aspect of the present invention provides a printhead assembly. The printhead assembly includes a base having a pocket formed therein, a substrate having at least one fluid passage formed therethrough received within the pocket of the base, and a printhead die supported by the substrate and communicated with the at least one fluid passage of the substrate.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. In addition, it is to be understood that any element(s), feature(s), structure(s), item(s), etc. of one specific embodiment is not limited to the specific embodiment, and may be used in other embodiments. The following detailed description, therefore, is not to be taken in a limiting sense, and the scope of the present invention is defined by the appended claims.

Figure 1:
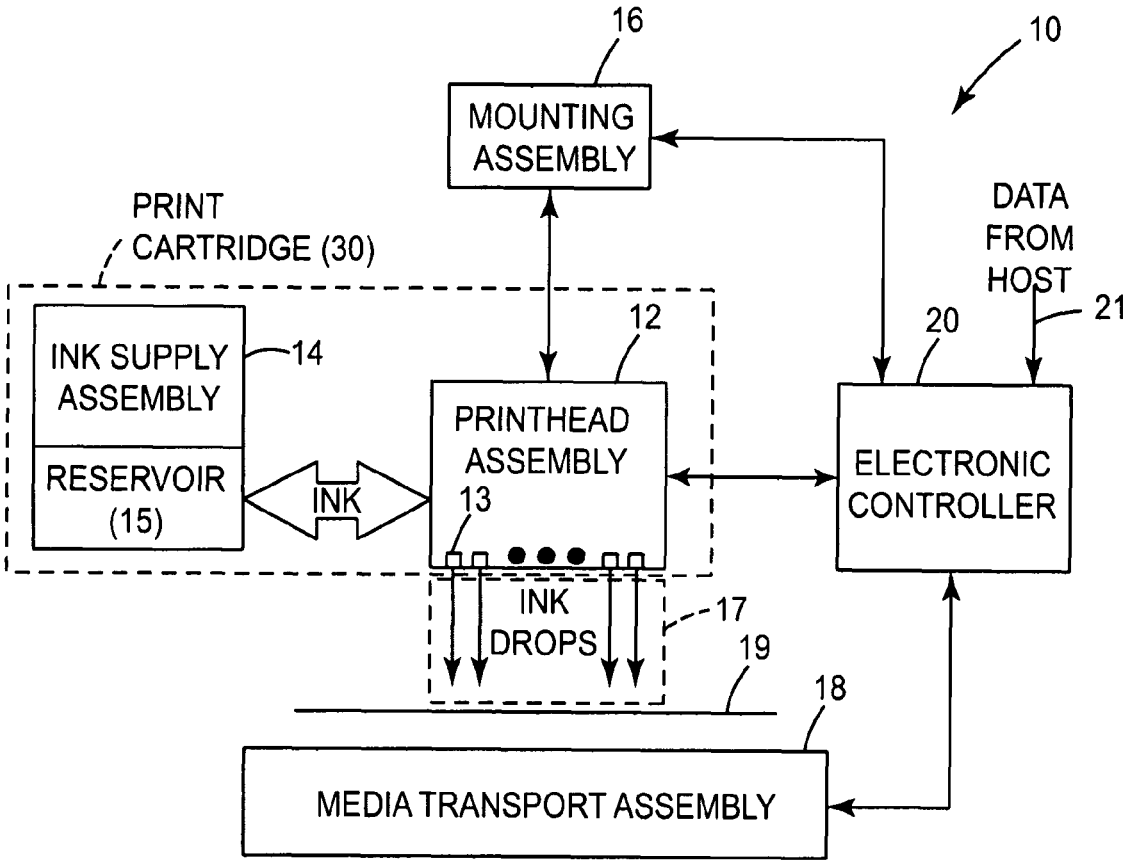
FIG. 1 is a block diagram illustrating one embodiment of an inkjet printing system.

FIG. 1 illustrates one embodiment of an inkjet printing system 10 according to the present invention. Inkjet printing system 10 constitutes one embodiment of a fluid ejection system which includes a fluid ejection device, such as a printhead assembly 12, and a fluid supply, such as an ink supply assembly 14. In the illustrated embodiment, inkjet printing system 10 also includes a mounting assembly 16, a media transport assembly 18, and an electronic controller 20.

Printhead assembly 12, as one embodiment of a fluid ejection device, is formed according to an embodiment of the present invention and ejects drops of ink, including one or more colored inks, through a plurality of orifices or nozzles 13. While the following description refers to the ejection of ink from printhead assembly 12, it is understood that other liquids, fluids, or flowable materials may be ejected from printhead assembly 12.

In one embodiment, the drops are directed toward a medium, such as print media 19, so as to print onto print media 19. Typically, nozzles 13 are arranged in one or more columns or arrays such that properly sequenced ejection of ink from nozzles 13 causes, in one embodiment, characters, symbols, and/or other graphics or images to be printed upon print media 19 as printhead assembly 12 and print media 19 are moved relative to each other.

Print media 19 includes, for example, paper, card stock, envelopes, labels, transparent film, cardboard, rigid panels, and the like. In one embodiment, print media 19 is a continuous form or continuous web print media 19. As such, print media 19 may include a continuous roll of unprinted paper.

Ink supply assembly 14, as one embodiment of a fluid supply, supplies ink to printhead assembly 12 and includes a reservoir 15 for storing ink. As such, ink flows from reservoir 15 to printhead assembly 12. In one embodiment, ink supply assembly 14 and printhead assembly 12 form a recirculating ink delivery system. As such, ink flows back to reservoir 15 from printhead assembly 12. In one embodiment, printhead assembly 12 and ink supply assembly 14 are housed together in an inkjet print cartridge or pen, as identified by dashed line 30. In another embodiment, ink supply assembly 14 is separate from printhead assembly 12 and supplies ink to printhead assembly 12 through an interface connection, such as a supply tube (not shown).

Mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined adjacent to nozzles 13 in an area between printhead assembly 12 and print media 19. During printing, print media 19 is advanced through print zone 17 by media transport assembly 18.

In one embodiment, printhead assembly 12 is a scanning type printhead assembly, and mounting assembly 16 moves printhead assembly 12 relative to media transport assembly 18 and print media 19 during printing of a swath on print media 19. In another embodiment, printhead assembly 12 is a non-scanning type printhead assembly, and mounting assembly 16 fixes printhead assembly 12 at a prescribed position relative to media transport assembly 18 during printing of a swath on print media 19 as media transport assembly 18 advances print media 19 past the prescribed position.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry forming a portion of electronic controller 20 is located off printhead assembly 12.

Figure 2:
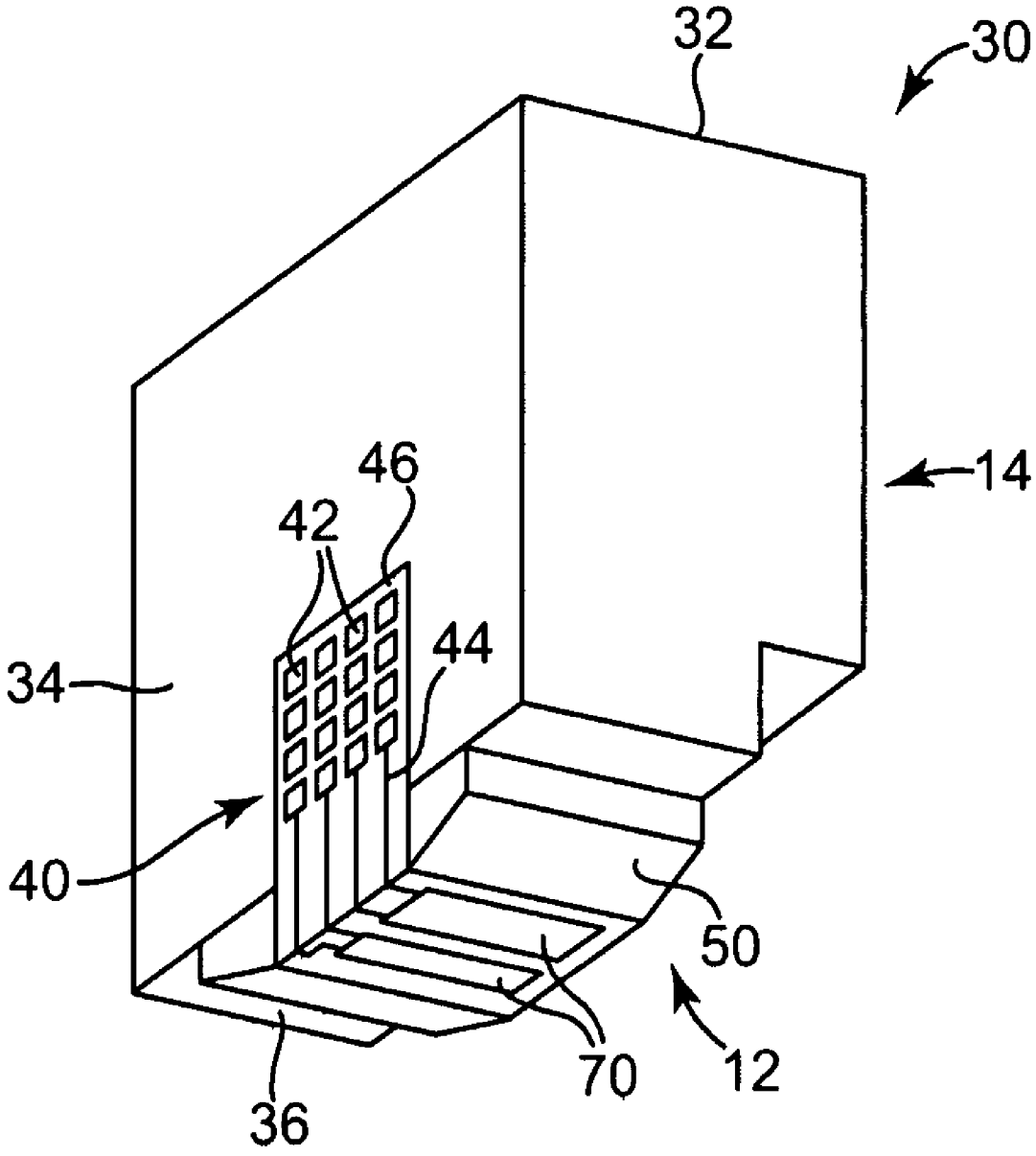
FIG. 2 is a perspective view illustrating one embodiment of an inkjet print cartridge.
Figure 3:
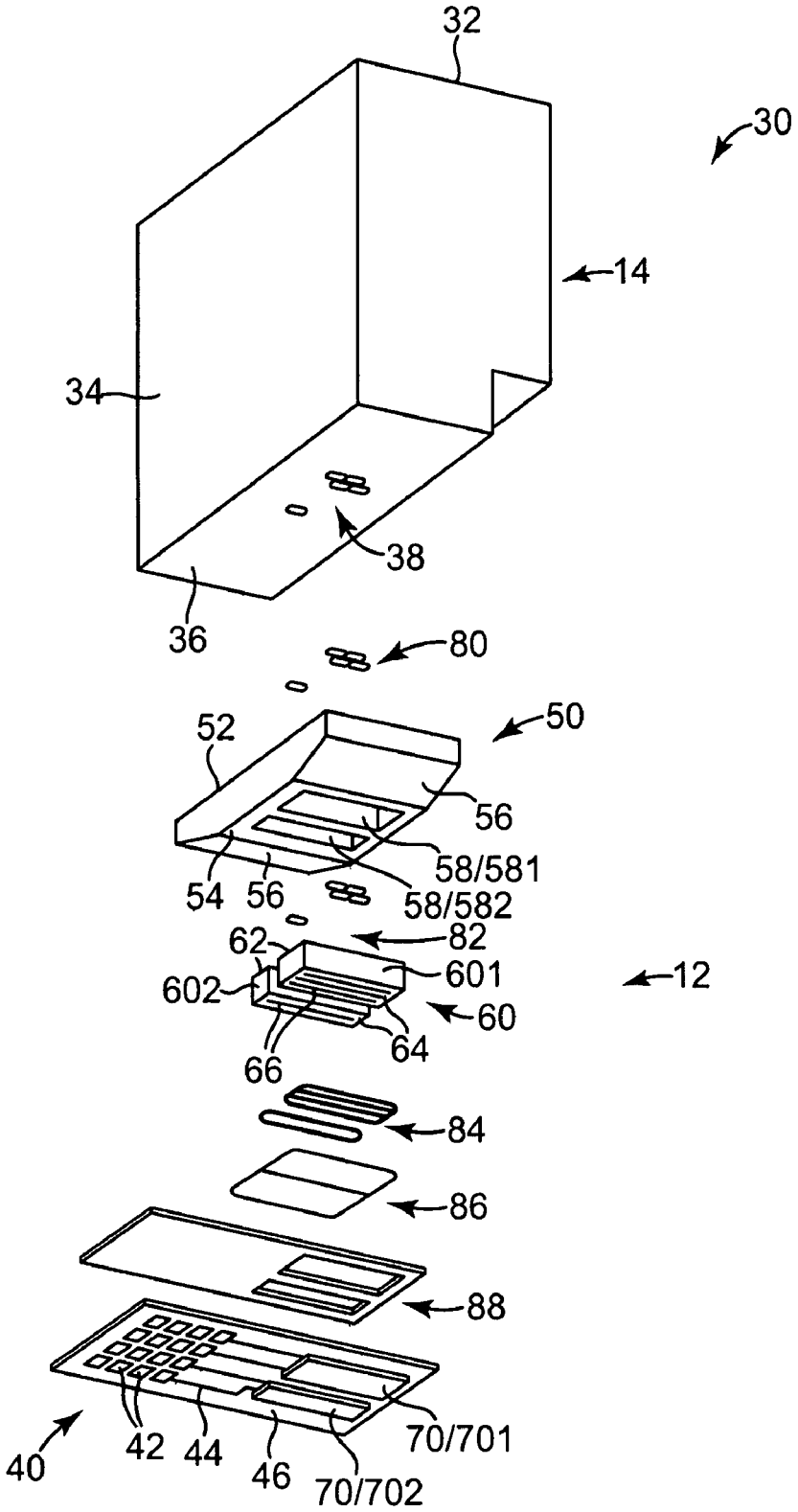
FIG. 3 is an exploded perspective view illustrating one embodiment of the inkjet print cartridge of FIG. 2.

In one embodiment, as illustrated in FIGS. 2 and 3, and as described below, printhead assembly 12 and ink supply assembly 14 are coupled or joined together as an inkjet print cartridge or pen 30. Print cartridge 30 includes a body or housing 32 which supports printhead assembly 12 and contains reservoir 15 (FIG. 1) of ink supply assembly 14. As such, reservoir 15 communicates with printhead assembly 12 to supply ink to printhead assembly 12. In addition, housing 32 supports an electrical circuit 40 which facilitates communication of electrical signals between electronic controller 20 (FIG. 1) and printhead assembly 12 for controlling and/or monitoring operation of printhead assembly 12.

In one embodiment, electrical circuit 40 includes a plurality of electrical contacts 42 and a plurality of conductive paths 44 which extend between and provide electrical connection between electrical contacts 42 and printhead assembly 12. Electrical contacts 42 provide points for electrical connection with print cartridge 30 and, more specifically, printhead assembly 12. As such, electrical contacts 42 facilitate communication of power, ground, and/or data signals to printhead assembly 12. In one embodiment, electrical circuit 40 is supported by print cartridge 30 such that electrical contacts 42 are provided along a side 34 of housing 32 of print cartridge 30.

In one embodiment, electrical circuit 40 is a flexible electrical circuit. As such, conductive paths 44 are formed in one or more layers of a flexible base material 46. Base material 46 may include, for example, a polyimide or other flexible polymer material (e.g., polyester, poly-methyl-methacrylate) and conductive paths 44 may be formed of copper, gold, or other conductive material.

In one embodiment, printhead assembly 12 is a modular printhead assembly formed of separate components including a base 50, one or more substrates 60, and one or more printhead dies 70. Base 50 and substrates 60 mate with each other and are configured such that base 50 and substrates 60 provide mechanical support for and accommodate fluidic routing to printhead dies 70, as described below.

Base 50 has a first side 52 and a second 54 which is opposite first side 52. In one embodiment, base 50 is supported by housing 32. More specifically, first side 52 of base 50 is secured to or mounted on a side 36 of housing 32. In one embodiment, one or more fluid outlets 38 (in fluid communication with reservoir 15 (FIG. 1) of ink supply assembly 14) are provided on side 36 of housing 32, and base 50 is mounted on side 36 of housing 32 so as to accommodate and/or communicate with fluid outlets 38.

In one embodiment, base 50 is secured to or mounted on housing 32 so as to provide a fluid-tight seal with housing 32. In one embodiment, for example, first side 52 of base 50 is secured to or mounted on side 36 of housing 32 by use of an adhesive 80 provided between base 50 and housing 32. Other connection methods providing a fluid-tight seal between base 50 and housing 32 may also be used.

In one embodiment, base 50 includes ramped surfaces 56. Ramped surfaces 56 are provided on opposite ends of second side 54 of base 50 and aid in preventing crashes between printhead assembly 12 and print media 19 (FIG. 1) as printhead assembly 12 and print media 19 are moved relative to each other during printing.

In one embodiment, base 50 includes one or more pockets 58 into which one or more substrates 60 are fit, as described below. Pockets 58 are open at least to second side 54 of base 50 and are sized and configured to receive and support substrates 60. Although base 50 is illustrated and described herein as having two pockets 58 each receiving and supporting one substrate 60, it is within the scope of the present invention for base 50 to have any number of pockets 58 each receiving and supporting one or more substrates 60.

Substrates 60 each have a first side 62 and a second side 64 which is opposite first side 62. In one embodiment, substrates 60 are fit or received within respective pockets 58 of base 50. More specifically, substrates 60 are fit or received within respective pockets 58 of base 50 such that second side 64 of substrates 60 is adjacent second side 54 of base 50. As such, pockets 58 position substrates 60 relative to housing 32, and position substrates 60 for supporting printhead dies 70, as described below. In one embodiment, pockets 58 and/or substrates 60 include various features (e.g., datum pads and/or lockout features) to ensure correct orientation and retention (e.g., press fit) of substrates 60 within pockets 58.

In one embodiment, substrates 60 are formed of a plastic, ceramic, glass, or other suitable material. When substrates 60 are formed of a plastic material, filler materials such as glass, carbon fibers, minerals, or other suitable filler materials may also be used. In addition, substrates 60 can be formed by a number of methods such as injection molding, pressing, machining, or etching depending on the substrate material.

In one embodiment, substrates 60 are secured or mounted within pockets 58 so as to provide a fluid-tight seal with base 50. In one embodiment, for example, first side 62 of substrates 60 is secured or mounted within pockets 58 by use of an adhesive 82 provided between substrates 60 and base 50. Other connection methods providing a fluid-tight seal between substrates 60 and base 50 may also be used.

In one embodiment, an area or footprint of each substrate 60 is approximately the same as an area or footprint of a respective printhead die 70 to provide support for the respective printhead die 70. More specifically, a length and a width of second side 64 of each substrate 60 approximates or is substantially equal to a length and a width of a respective printhead die 70.

In addition, in one embodiment, substrates 60 have one more fluid passages 66 formed therethrough. Fluid passages 66 communicate with first side 62 and second side 64 of substrates 60 and provide fluidic routing for printhead dies 70, as described below.

In one embodiment, printhead dies 70 include a thin-film structure formed on a substrate. The substrate is formed, for example, of silicon, glass, or a stable polymer, and the thin-film structure includes a conductive layer and one or more passivation or insulation layers.

In one embodiment, printhead dies 70 are joined with or mounted on electrical circuit 40 such that printhead dies 70 and electrical circuit 40 are supported by substrates 60 and base 50. Printhead dies 70 are supported by substrates 60 so as to communicate with respective fluid passages 66. As such, fluid passages 66 of substrates 60 provide fluidic routing to printhead dies 70 through base 50. In one embodiment, electrical circuit 40 wraps around and is supported by side 34 of housing 32 of print cartridge 30, as described above.

In one embodiment, printhead dies 70 and electrical circuit 40 are secured to or mounted on substrates 60 and base 50 so as to provide a fluid-tight seal with substrates 60 and base 50. In one embodiment, for example, printhead dies 70 are secured to or mounted on second side 64 of substrates 60 by use of an adhesive 84 provided between printhead dies 70 and substrates 60, and electrical circuit 40 is secured to or mounted on second side 54 of base 50 by use of an adhesive 86 provided between electrical circuit 40 and base 50. In one embodiment, an attach layer 88 is interposed between electrical circuit 40 and base 50. Other connection methods providing a fluid-tight seal between printhead dies 70 and substrates 60, and between electrical circuit 40 and base 50 may also be used.

In one embodiment, adhesive 80, adhesive 82, adhesive 84, and/or adhesive 86 is selected to help absorb stresses which otherwise may be imparted to printhead dies 70. In one exemplary embodiment, adhesive 80, adhesive 82, adhesive 84, and/or adhesive 86 has a glass transition temperature (Tg) of about 65° C. with a modulus of less than approximately 100 MPa at temperatures above the glass transition and a modulus of above 1000 MPa at temperatures below the glass transition.

In one embodiment, pockets 58 of base 50 include a first pocket 581 and a second pocket 582, substrates 60 include a first substrate 601 and a second substrate 602, and printhead dies 70 include a first printhead die 701 and a second printhead die 702. As such, substrate 601 is received within pocket 581 of base 50, and substrate 602 is received within pocket 582 of base 50. In addition, printhead die 701 is mated with and supported by substrate 601, and printhead die 702 is mated with and supported by substrate 602. Thus, in one embodiment, base 50 supports substrates 601 and 602 and printhead dies 701 and 702, and substrates 601 and 602 support respective printhead dies 701 and 702 and provide fluidic routing to respective printhead dies 701 and 702 through base 50.

Figure 4A:
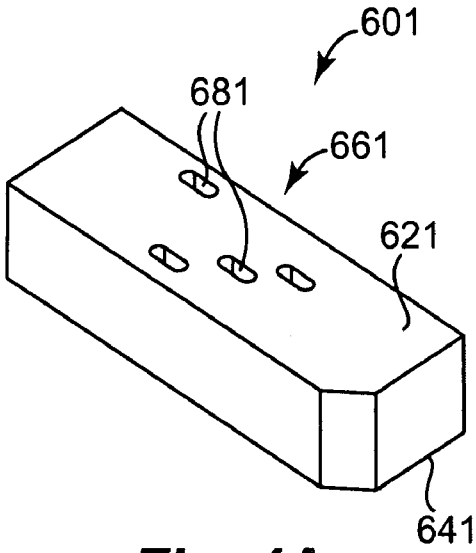
FIGS. 4A and 4B are perspective views illustrating one embodiment of a substrate of the inkjet print cartridge of FIGS. 2 and 3.
Figure 4B:
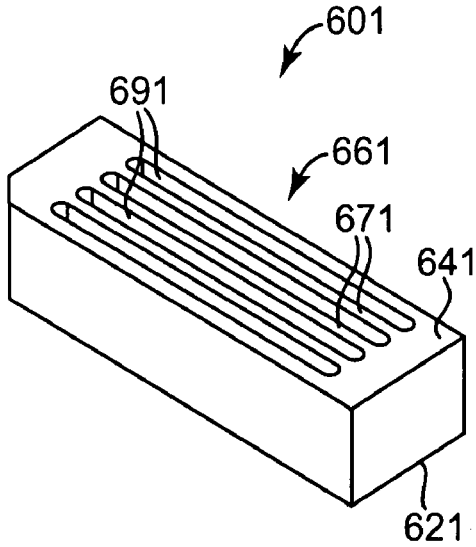

FIGS. 4A and 4B illustrate one embodiment of substrate 601. Substrate 601 has a first side 621 and a second side 641 opposite first side 621, and has fluid passages 661 formed therethrough. In one embodiment, substrate 601 includes ribs 671 provided between adjacent fluid passages 661. Ribs 671 provide support for printhead die 701 and, in one embodiment, an area for adhering printhead die 701 to substrate 601.

Fluid passages 661 communicate with first side 621 and second side 641 so as to provide fluidic routing through substrate 601. In one embodiment, fluid passages 661 include four fluid passages each routing a different color or type of ink to printhead die 701. The different colors of ink may include, for example, cyan, magenta, light cyan, light magenta, yellow, black, or gray.

In one embodiment, fluid passages 661 each include a fluid inlet 681 communicated with first side 621, and a fluid slot 691 communicated with second side 641. As such, each fluid inlet 681 is communicated with a respective fluid outlet 38 provided on side 36 of housing 32 when substrate 601 is received within pocket 581 of base 50 and base 50 is mounted on side 36 of housing 32. In addition, each fluid slot 691 is communicated with printhead die 701 when printhead die 701 is mounted on or supported by substrate 601. Although substrate 601 is illustrated as having four fluid passages 661 formed therethrough, it is within the scope of the present invention for any number of fluid passages to be formed through substrate 601.

Figure 5A:
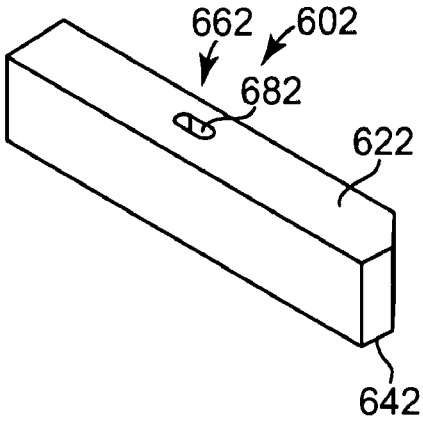
FIGS. 5A and 5B are perspective views illustrating another embodiment of a substrate of the inkjet print cartridge of FIGS. 2 and 3.
Figure 5B:
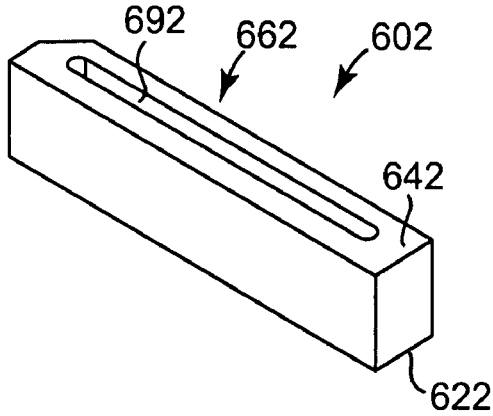

FIGS. 5A and 5B illustrate one embodiment of substrate 602. Substrate 602 has a first side 622 and a second side 642 opposite first side 622, and has a fluid passage 662 formed therethrough. Fluid passage 662 communicates with first side 622 and second side 642 so as to provide fluidic routing through substrate 602.

In one embodiment, fluid passage 662 includes a fluid inlet 682 communicated with first side 622 and a fluid slot 692 communicated with second side 642. As such, fluid inlet 682 is communicated with a respective fluid outlet 38 provided on side 36 of housing 32 when substrate 602 is received within pocket 582 of base 50 and base 50 is mounted on side 36 of housing 32. In addition, fluid slot 692 is communicated with printhead die 702 when printhead die 702 is mounted on or supported by substrate 602. Although substrate 602 is illustrated as having one fluid passage 662 formed therethrough, it is within the scope of the present invention for any number of fluid passages to be formed through substrate 602.

In one embodiment, substrates 60 are interchangeable substrates such that different substrates may be received within pockets 58 of base 50. The different substrates may include, for example, substrates 60 having different material properties, different dimensional properties, and/or different fluidic geometries. Various characteristics of substrates 60 may be chosen, for example, to minimize or isolate potential stresses imparted to printhead dies 70 and/or optimize or balance performance aspects of printhead assembly 12. As such, different substrates having different material properties, different dimensional properties, and/or different fluidic geometries may be received within pockets 58 and supported by a single or common base 50. Thus, the same base 50 may receive and support different substrates 60 having different material properties, different dimensional properties, and/or different fluidic geometries.

The different material properties of substrates 60 may include, for example, forming substrates 60 of plastic (with or without a filler material), ceramic, glass, or other suitable materials. The different dimensional properties of substrates 60 may include, for example, varying widths and/or lengths of ribs 671. The different fluidic geometries of substrates 60 may include, for example, differing widths of fluid passages 66, differing volumes or shapes (i.e., slopes) of fluid passages 66, and/or differing spacing or pitches between fluid passages 66.

Forming base 50 and substrates 60 as separate components, allows for various design and/or material selection variations for base 50 and/or substrates 60. For example, substrates 60 may be formed of various materials to minimize or isolate manufacturing-induced or in-use stresses which may develop between substrates 60 and printhead dies 70 as a result, for example, of differing coefficients of thermal expansion (CTE). By forming substrates 60 with a footprint substantially equal to a footprint of respective printhead dies 70, a material of substrates 60 may be selected to minimize CTE mismatch and/or isolate printhead dies 70 from manufacturing-induced or in-use stresses.

In addition, substrates 60 may be designed with varying fluid slot layouts to enable printhead dies 70 with different swath lengths, fluid slot widths, and/or fluid slot pitches to be used with a common base 50 or housing 32, and substrates 60 with different fluidic geometries may be used to enable or modify various printer performance attributes. For example, fluid slot widths may vary depending upon a particular ink used in each slot (which may outgas more air than another and needs more volume to store this air), or depending upon performance requirements of a particular slot (with higher drop weight, for example, a slot may need to be wider to enable faster development of ink flow), or to accommodate printhead dies having different slot pitches on the same system. Rib widths may also be adjusted to be wider between more aggressive inks in adjacent slots thereby allowing a wider adhesive bond line between aggressive inks to help provide a more reliable bond which may be more resistant to time-dependent failure modes.

In addition, substrates 60 with different thermal properties may be provided to enable or modify printer performance attributes or enable specific thermal assembly processes, and substrates 60 of different materials may be used to optimize specific attributes of the adhesive(s) used to attach printhead dies 70 to substrates 60 and substrates 60 to base 50. In addition, adhesives provided between base 50 and substrates 60 and between substrates 60 and printhead dies 70 may also help to absorb stresses which may be generated during processing and/or operation of printhead assembly 12.

In addition, forming base 50 and substrate 60 as separate components allows for optimization of part design for component manufacture. For example, in the case of plastic injection molding, the thin ribs of substrate 60 (which are spaced to match the die slot spacing) may be difficult to fill properly with highly filled plastic materials especially when these features are integrated into a larger part (e.g., a unitary base and substrate). But when base 50 and substrate 60 are separate components, their respective designs can be optimized to allow for molding efficiency.

Furthermore, the material of base 50 can be selected independently from the material of substrates 60 so as to facilitate securing of electrical circuit 40 to base 50, to allow other thermal processing options (e.g., a plastic loaded with a material such as carbon that couples with microwave energy to allow microwave heating of base 50 which in turn cures adhesives 80 and 82), and/or to provide specific mechanical properties (e.g., a stiff or creep-resistant material to resist deformation due to stresses imparted to base 50 from other components such as a compressed gasket which could be used instead of adhesive 80 between base 50 and housing 32).

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A printhead assembly, comprising:

a base having a pocket formed therein;

a substrate having at least one fluid passage formed therethrough received within the pocket of the base; and a printhead die supported by the substrate and communicated with the at least one fluid passage of the substrate, wherein the substrate is interchangeable with another substrate configured to be received within the pocket of the base, the another substrate having at least one fluid passage formed therethrough.

2. The printhead assembly of claim 1, wherein the substrate has a first side and a second side opposite the first side, and the at least one fluid passage communicates with the first side and the second side, and wherein the printhead die is supported by the second side of the substrate.

3. The printhead assembly of claim 2, wherein a footprint of the second side of the substrate is substantially equal to a footprint of the printhead die.

4. The printhead assembly of claim 2, wherein the base has a first side and a second side opposite the first side, and the pocket is open to at least the second side of the base, and wherein the substrate is received within the pocket of the base such that the second side of the substrate is adjacent the second side of the base.

5. The printhead assembly of claim 1, wherein the at least one fluid passage of the substrate includes a fluid inlet communicated with one side of the substrate and a fluid slot communicated with an opposite side of the substrate, and wherein the printhead die is communicated with the fluid slot.

6. The printhead assembly of claim 1, wherein the at least one fluid passage of the substrate comprises a plurality of fluid passages, and wherein the printhead die is communicated with each of the fluid passages.

7. The printhead assembly of claim 1, wherein the substrate and the another substrate have different material properties.

8. The printhead assembly of claim 1, wherein the substrate and the another substrate have different dimensional properties.

9. The printhead assembly of claim 1, wherein the substrate and the another substrate have different fluid geometries.

10. The printhead assembly of claim 1, further comprising:

a housing including a fluid reservoir, wherein the base is supported by the housing, and wherein the fluid passage of the substrate is communicated with the fluid reservoir of the housing.

11. The printhead assembly of claim 1, further comprising:

an electrical circuit electrically coupled to the printhead die, wherein the electrical circuit is supported by the base and includes electrical contacts configured to communicate at least one of a power signal, a ground signal, and a data signal to the printhead die.

12. The printhead assembly of claim 11, wherein the electrical circuit includes conductive paths provided in a layer of flexible material.

13. A printhead assembly, comprising:

a base having a pocket formed therein;

a substrate having at least one fluid passage formed therethrough received within the pocket of the base; and a printhead die supported by the substrate and communicated with the at least one fluid passage of the substrate, wherein the base has another pocket formed therein, wherein another substrate having at least one fluid passage formed therethrough is received within the another pocket of the base, and wherein another printhead die is supported by the another substrate and communicated with the least one fluid passage of the another substrate.

14. A printhead assembly, comprising:

a printhead die;

a base having a pocket formed therein; and means received within the pocket of the base for supporting the printhead die and providing fluidic routing to the printhead die through the base, wherein the means for supporting the printhead die and providing fluidic routing to the printhead die comprises interchangeable means received within the pocket of the base for supporting the printhead die and providing fluidic routing to the printhead die through the base.

15. The printhead assembly of claim 14, wherein the means for supporting the printhead die and providing fluidic routing to the printhead die includes at least one fluid passage, wherein the at least one fluid passage is communicated with the printhead die.

16. The printhead assembly of claim 14, wherein the means for supporting the printhead die and providing fluidic routing to the printhead die has a footprint substantially equal to a footprint of the printhead die.

17. The printhead assembly of claim 14, wherein the interchangeable means includes different material properties.

18. The printhead assembly of claim 14, wherein the interchangeable means includes different dimensional properties.

19. The printhead assembly of claim 14, wherein the interchangeable means includes different fluid geometries.

20. The printhead assembly of claim 14, further comprising:

a housing including a fluid reservoir, wherein the base is supported by the housing, and wherein the means for supporting the printhead die and providing fluidic routing to the printhead die is communicated with the fluid reservoir of the housing.

21. The printhead assembly of claim 14, further comprising:

an electrical circuit electrically coupled to the printhead die, wherein the electrical circuit is supported by the base and includes electrical contacts configured to communicate at least one of a power signal, a ground signal, and a data signal to the printhead die.

22. The printhead assembly of claim 21, wherein the electrical circuit includes conductive paths provided in a layer of flexible material.

23. A printhead assembly, comprising:

a printhead die;

a base having a pocket formed therein; and means received within the pocket of the base for supporting the printhead die and providing fluidic routing to the printhead die through the base, wherein the base has another pocket formed therein, and further comprising:

another printhead die; and means received within the another pocket of the base for supporting the another printhead die and providing fluidic routing to the another printhead die through the base.

24. A method of forming a printhead assembly, the method comprising:

providing a base having a pocket formed therein;

receiving a substrate having at least one fluid passage formed therethrough within the pocket of the base;

supporting a printhead die on the substrate, including communicating the printhead die with the at least one fluid passage of the substrate; and interchanging the substrate with another substrate including receiving the another substrate within the pocket of the base, the another substrate having at least one fluid passage formed therethrough.

25. The method of claim 24, wherein the substrate has a first side and a second side opposite the first side, and the at least one fluid passage communicates with the first side and the second side, and wherein supporting the printhead die on the substrate includes supporting the printhead die on the second side of the substrate.

26. The method of claim 25, wherein supporting the printhead die on the second side of the substrate includes supporting the printhead die over a footprint substantially equal to a footprint of the printhead die.

27. The method of claim 25, wherein the base has a first side and a second side opposite the first side, and the pocket is open to at least the second side of the base, and wherein receiving the substrate within the pocket includes providing the second side of the substrate adjacent the second side of the base.

28. The method of claim 24, wherein the at least one fluid passage of the substrate includes a fluid inlet communicated with one side of the substrate, and a fluid slot communicated with an opposite side of the substrate, wherein supporting the printhead die on the substrate includes communicating the printhead die with the fluid slot.

29. The method of claim 24, wherein the at least one fluid passage of the substrate comprises a plurality of fluid passages, and wherein supporting the printhead die on the substrate includes communicating the printhead die with each of the fluid passages.

30. The method of claim 24, wherein the substrate and the another substrate have different material properties.

31. The method of claim 24, wherein the substrate and the another substrate have different dimensional properties.

32. The method of claim 24, wherein the substrate and the another substrate have different fluid geometries.

33. The method of claim 24, further comprising:

supporting the base on a housing including a fluid reservoir, including communicating the at least one fluid passage of the substrate with the fluid reservoir.

34. The method of claim 24, further comprising:

electrically coupling an electrical circuit to the printhead die and supporting the electrical circuit with the base, wherein the electrical circuit includes electrical contacts configured to communicate at least one of a power signal, a ground signal, and a data signal to the printhead die.

35. The method of claim 34, wherein the electrical circuit includes conductive paths provided in a layer of flexible material.

36. A method of forming a printhead assembly, the method comprising:

providing a base having a pocket formed therein;

receiving a substrate having at least one fluid passage formed therethrough within the pocket of the base; and supporting a printhead die on the substrate, including communicating the printhead die with the at least one fluid passage of the substrate, wherein the base has another pocket formed therein, and further comprising:

receiving another substrate having at least one fluid passage formed therethrough within the another pocket of the base; and supporting another printhead die on the another substrate, including communicating the another printhead die with the at least one fluid passage of the another substrate.

* * * * *